US010465142B2

(12) United States Patent
Ueda et al.

(10) Patent No.: US 10,465,142 B2
(45) Date of Patent: Nov. 5, 2019

(54) LUBRICATING OIL COMPOSITION FOR INTERNAL COMBUSTION ENGINES

(71) Applicant: SHELL OIL COMPANY, Houston, TX (US)

(72) Inventors: Mao Ueda, Aikou (JP); Kiyoshi Hanyuda, Aikou (JP); Kouichi Kubo, Aikou (JP)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 15/534,072

(22) PCT Filed: Dec. 9, 2015

(86) PCT No.: PCT/EP2015/079072
§ 371 (c)(1),
(2) Date: Jun. 8, 2017

(87) PCT Pub. No.: WO2016/091926
PCT Pub. Date: Jun. 16, 2016

(65) Prior Publication Data

US 2017/0349855 A1 Dec. 7, 2017

(30) Foreign Application Priority Data

Dec. 11, 2014 (JP) ..... 2014-251286

(51) Int. Cl.

| | |
|---|---|
| ***C10M 169/04*** | (2006.01) |
| ***C10M 163/00*** | (2006.01) |
| ***C10M 101/00*** | (2006.01) |
| ***C10M 133/44*** | (2006.01) |
| ***C10M 139/00*** | (2006.01) |
| ***C10M 141/12*** | (2006.01) |

(52) U.S. Cl.

CPC ..... *C10M 169/04* (2013.01); *C10M 101/00* (2013.01); *C10M 133/44* (2013.01); *C10M 139/00* (2013.01); *C10M 141/12* (2013.01); *C10M 163/00* (2013.01); *C10M 169/045* (2013.01); *C10M 2203/003* (2013.01); *C10M 2203/1006* (2013.01); *C10M 2203/1025* (2013.01); *C10M 2205/04* (2013.01); *C10M 2205/173* (2013.01); *C10M 2207/26* (2013.01); *C10M 2207/262* (2013.01); *C10M 2207/289* (2013.01); *C10M 2209/084* (2013.01); *C10M 2215/064* (2013.01); *C10M 2215/28* (2013.01); *C10M 2215/30* (2013.01); *C10M 2219/046* (2013.01); *C10M 2223/045* (2013.01); *C10M 2227/06* (2013.01); *C10M 2227/061* (2013.01); *C10M 2227/062* (2013.01); *C10M 2229/02* (2013.01); *C10N 2220/022* (2013.01); *C10N 2220/023* (2013.01); *C10N 2230/04* (2013.01); *C10N 2230/06* (2013.01); *C10N 2230/08* (2013.01); *C10N 2230/10* (2013.01); *C10N 2230/12* (2013.01); *C10N 2230/52* (2013.01); *C10N 2230/74* (2013.01); *C10N 2240/10* (2013.01)

(58) Field of Classification Search

CPC ..... C10M 2207/262; C10M 2215/28; C10M 2223/045; C10M 2227/061
USPC ..... 508/186
See application file for complete search history.

(56) References Cited

U.S. PATENT DOCUMENTS

2013/0123155 A1* 5/2013 Li ..... C10M 141/12 508/186

OTHER PUBLICATIONS

Hamanaka, Semipolar Organoboron Surfactants VI, Preparation of Water-soluble Organoboron Surfactants, p. 59-64, 1977.*

* cited by examiner

*Primary Examiner* — Vishal V Vasisth

(57) ABSTRACT

A lubricating oil composition for internal combustion engines is disclosed. The composition exhibits a lower coefficient of friction and improved cleaning properties without causing a deterioration in thermal and oxidation stability.

5 Claims, No Drawings

LUBRICATING OIL COMPOSITION FOR INTERNAL COMBUSTION ENGINES

PRIORITY CLAIM

The present application is the National Stage (§ 371) of International Application No.PCT/EP2015/079072, filed Dec. 9,2015, which claims priority from Japanese Patent Application No. 2014-251286, filed Dec. 11, 2014 incorporated herein by reference.

FIELD OF THE INVENTION

The present invention relates to a lubricating oil composition. More specifically, the present invention relates to a lubricating oil composition for internal combustion engines, which has a low coefficient of friction and exhibits excellent cleaning properties at high temperatures.

BACKGROUND OF THE INVENTION

Many lubricating oil compositions for internal combustion engines have been proposed in the past. For example, JP 2003-073685 discloses a lubricating oil composition for internal combustion engines, which exhibits excellent abrasion resistance and high temperature cleaning properties.

In order to improve fuel economy, it is important to prevent energy losses caused by friction inside an engine when an automobile is running. That is, reducing the coefficient of friction of sliding parts by adding a friction modifier, as disclosed in JP 2003-073685, is effective for improving fuel economy. In addition, adding a viscosity index improving agent is effective for lowering kinematic viscosity at low temperatures while maintaining kinematic viscosity at high temperatures and for lowering viscous drag at low oil temperatures.

However, friction modifiers and polymethacrylate-based viscosity index improving agents, which exhibit a significant viscosity index improvement effect, readily undergo thermal decomposition, adversely effect the cleaning properties of engine oils and are thought to hasten the generation of sludge. In particular, there are concerns that viscosity index improving agents and viscosity modifiers will undergo thermal decomposition and cause a build-up of sludge around piston rings and at piston under crowns, which are exposed to high temperatures. In particular, if sludge around a piston rings causes the piston ring to stick, it is not possible to reliably seal in combustion gases by means of the cylinder and the piston ring, and this leads to a deterioration in fuel economy and abnormal wearing between the cylinder and the ring. In addition, if sludge builds up at an under crown, thermal conductivity deteriorates, heat from the combustion chamber cannot escape, abnormal thermal expansion occurs due to high temperatures, and piston cracking and so on can occur.

Therefore, in order to suppress oil oxidation, suppress the generation of sludge and increase engine protection performance, it is important for an oil to exhibit excellent oxidation stability and cleaning properties. Boron-modified dispersing agents are used to improve cleaning properties at high temperatures.

However, the use of boron-modified dispersing agents is not effective for lowering friction, leads to a deterioration in thermal and oxidation stability and corrosion of metals, and leads to an increase in the acid value of an oil and corrosion of non-ferrous metals.

Therefore, the present invention addresses the problem of providing a lubricating oil composition for internal combustion engines, which exhibits a lower coefficient of friction and improved cleaning properties without causing a deterioration in thermal and oxidation stability and corrosion of metals.

SUMMARY OF INVENTION

As a result of diligent search into how to solve the problem mentioned above, the inventors of the present invention found that adding an oil-soluble semi-polar organic boron surfactant lowered the coefficient of friction and improved cleaning properties without causing a deterioration in thermal and oxidation stability and corrosion of metals, and thereby completed the present invention.

Accordingly the present invention provides a lubricating oil composition for internal combustion engines, which comprises the following components:

a) a lubricant base oil having a kinematic viscosity at 100° C. of from 2 to 12 $mm^2/s$, which is a single API group 2 or group 3 base oil having a viscosity index of 95 or higher, a sulfur content of 0.03 mass % or lower and % CA value of 1 or lower, or a plurality thereof, (b) a nitrogen-containing ashless dispersing agent at a quantity of 0.01-0.3 mass % in terms of nitrogen content relative to the overall composition, (c) a metal-containing detergent, which contains calcium and/or magnesium as an alkaline earth metal, at a quantity of 0.05-0.3 mass % in terms of alkaline earth metal content relative to the overall composition, (d) a zinc dialkyldithiophosphate at a quantity of 0.05-0.13 mass % in terms of phosphorus content relative to the overall composition, and (e) an oil-soluble semi-polar organic boron glycerol ester compound represented by chemical formula 1, (1)

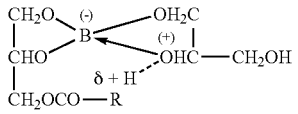

at a quantity of 0.015-0.040 mass % in terms of boron content relative to the overall composition, wherein R denotes a straight chain or branched chain alkyl group or straight chain or branched chain alkenyl group having 7-20 carbon atoms.

According to the present invention, it is possible to provide a lubricating oil composition for internal combustion engines, which exhibits a lower coefficient of friction and improved cleaning properties without causing a deterioration in thermal and oxidation stability.

DETAILED DESCRIPTION OF THE INVENTION

Detailed explanations will now be given of the composition (specific components and blending quantities of the components), physical properties and intended uses of the lubricating oil composition for internal combustion engines of the present mode, but the present invention is not limited to these.

First, explanations will be given of the components in the lubricating oil composition for internal combustion engines according to the present invention, and the blending quantities of these components.

The base oil according to the present invention is (a) a lubricant base oil having a kinematic viscosity at 100° C. of from 2 to 12 $mm^2/s$, which is a single API group 2 or group 3 base oil having a viscosity index of 95 or higher, a sulfur content of 0.03 mass % or lower and % CA value of 1 or lower, or a plurality thereof.

The kinematic viscosity at 100° C. is preferably from 2 to 12 $mm^2/s$, more preferably from 3 to 12 $mm^2/s$, and further preferably from 5 to 12 $mm^2/s$. If the kinematic viscosity at 100° C. is lower than 2 $mm^2/s$, it becomes necessary to use a large quantity of viscosity index improving agent in order to achieve the required viscosity of the lubricating oil composition for internal combustion engines, which leads to concerns regarding shear stability. Meanwhile, if the kinematic viscosity at 100° C. exceeds 12 $mm^2/s$, the kinematic viscosity at low temperatures increases, viscous drag increases, and it is difficult to lower engine friction. In addition, the kinematic viscosity at 40° C. may be from 5 to 150 $mm^2/s$, and more preferably from 5 to 120 $mm^2/s$.

The viscosity index is preferably 95 or higher, and more preferably 100 or higher. If the viscosity index is lower than 95, the viscosity at low temperatures increases, engine friction increases due to viscous drag increasing, and there are concerns regarding a deterioration in fuel economy.

The sulfur content is preferably 0.03 mass % or lower, more preferably 0.01 mass % or lower, and further preferably 0.005 mass % or lower. If the sulfur content exceeds 0.03 mass %, there are concerns regarding a deterioration in oxidation stability.

The % CA value is preferably 1 or lower, and more preferably 0.5 or lower. If the % CA value exceeds 1, the number of unsaturated bonds in base oil molecules increases, which leads to concerns regarding thermal and oxidation stability. The % CA value (aromatic component content) of the base oil in the present invention is measured by n-d-M analysis in accordance with ASTM D3238.

The base oil according to the present invention is a single group 2 or group 3 base oil that satisfies the conditions mentioned above, or a plurality thereof.

The present invention may contain base oils other than the base oil mentioned above as long as the effect of the invention is not impaired. For example, it is possible to incorporate a group 1 base oil having a kinematic viscosity at 100° C. of from 2 to 12 $mm^2/s$, a % CA value of 5 or lower and a sulfur content of less than 0.8 mass %, or a group 4 or group 5 base oil having a kinematic viscosity at 100° C. of 2-12 $mm^2/s$, at a quantity of up to 10 mass % relative to the overall quantity of the composition.

The nitrogen-containing ashless dispersing agent according to the present invention is a publicly known lubricating oil additive. The content of the nitrogen-containing ashless dispersing agent is preferably 0.01-0.3 mass %, more preferably 0.05-0.3 mass %, and further preferably 0.05-0.2 mass %, in terms of nitrogen content relative to the overall quantity of the composition. If this content is lower than 0.01 mass %, there are concerns that the required dispersion performance cannot be achieved, and if this content exceeds 0.3 mass %, there are concerns that the viscosity will increase and low temperature fluidity will deteriorate.

In order to increase the effect of the present invention, it is preferable for the nitrogen-containing ashless dispersing agent to be an additive selected from among the group consisting of a boronated or non-boronated alkylsuccinimide or alkenylsuccinimide, a boronated or non-boronated alkylsuccinic acid ester or alkenylsuccinic acid ester, a boronated or non-boronated alkylsuccinic acid imide or alkenylsuccinic acid imide, a boronated or non-boronated alkylsuccinic acid amide or alkenylsuccinic acid amide, or an arbitrary combination thereof.

Examples of ashless succinic acid imide dispersing agents and boron-modified ashless succinic acid imide dispersing agents include the substances listed below. Examples of succinic acid imide dispersing agents include nitrogen-containing compounds such as alkenyl group-containing or alkyl group-containing succinic acid imides derived from polyolefins, benzylamine, polyamines and Mannich bases. In addition, the succinic acid imide dispersing agent can be a derivative obtained by causing a phosphorus compound, such as thiophosphoric acid or a thiophosphate, an organic acid, a hydroxypolyoxyalkylene carbonate, or the like, to act on these nitrogen-containing compounds. Examples of boron-modified ashless succinic acid imide dispersing agents include derivatives obtained by causing a boron compound such as boric acid or a borate to act on these nitrogen-containing compounds.

The dispersing agent in the present embodiment should be constituted from a single dispersing agent arbitrarily selected from among those listed above, or two or more types thereof. Moreover, it is particularly preferable for the ashless dispersing agent to be a bis type polybutenyl succinic acid imide, a derivative of a bis type polybutenyl succinic acid imide, or a mixture thereof.

Here, the alkenyl groups and alkyl groups mentioned above may be straight chain or branched chain. Specifically, the alkenyl groups and alkyl groups are alkenyl groups and alkyl groups derived from oligomers of olefins such as propylene, 1-butene and isobutylene and cooligomers of ethylene and propylene. It is preferable for branched chain alkyl groups and branched chain alkenyl groups to be derived from a polyisobutene, which is a type of polybutene, having a number average molecular weight of 500-5000, more preferably 700-4000, and further preferably 900-3000. The molecular weights of polymer additives can be obtained by, for example, using a Shodex GPC-101 high performance liquid chromatography apparatus manufactured by Showa Denko Kabushiki Kaisha, setting a temperature of 40° C., using a differential refractive index (RI) detector as a detector, using THF as a carrier gas at a flow rate of 1.0 ml/min (Ref 0.3 ml/min), setting the sample injection quantity to be 100 μL, using a combination of {KF-G (Shodex)×1 and KF-805L (Shodex×2)} as a column, using a range that corresponds to the peak molecular weight, and calculating the average molecular weight (weight average molecular weight and number average molecular weight in terms of polystyrene).

The weight average molecular weight of the ashless dispersing agent is preferably from 1000 to 20,000, more preferably from 1500 to 10,000, and further preferably from 5000 to 10,000. If the weight average molecular weight of the ashless dispersing agent is lower than 1000, the molecular weight of polybutenyl groups, which are non-polar groups, is low, meaning that the dispersing agent surrounds a large quantity of sludge and it is not possible to achieve dispersion in a hydrocarbon base oil that is a non-polar solvent. In addition, if the weight average molecular weight of the ashless dispersing agent exceeds 20,000, viscosity at low temperature increases, meaning that the temperature-viscosity characteristics of the lubricating oil composition deteriorate. The weight average molecular weight of the ashless dispersing agent can be determined by using, for example, the method mentioned above.

The metal-containing detergent according to the present invention is a publicly known lubricating oil additive that contains calcium and/or magnesium as an alkaline earth metal. The content of the metal-containing detergent is preferably from 0.05 to 0.3 mass %, more preferably from 0.1 to 0.3 mass %, and further preferably from 0.2 to 0.3 mass %, in terms of alkaline earth metal content relative to the overall quantity of the composition. If this content is lower than 0.05 mass %, there are concerns that the required basicity and cleaning properties cannot be achieved, and if this content exceeds 0.3 mass %, there are concerns that the ash content will increase and DPF clogging will occur.

It is preferable for the metal-containing detergent to contain a salicylate, a carboxylate or a sulfonate as a primary component.

The anti-wear agent according to the present invention is a zinc dialkyldithiophosphate. The content of the zinc dialkyldithiophosphate is preferably from 0.05 to 0.13 mass %, and more preferably from 0.06 to 0.13 mass %, in terms of phosphorus content relative to the overall quantity of the composition. If this content is lower than 0.05 mass %, there are concerns that the required abrasion resistance cannot be achieved, and if this content exceeds 0.13 mass %, there are concerns regarding catalyst poisoning by phosphorus and DPF clogging.

The zinc dialkyldithiophosphate can be, for example, a compound represented by chemical formula 3 below:

(3)

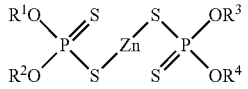

In chemical formula 3 above, $R^1$, $R^2$, $R^3$ and $R^4$ each independently denote a hydrocarbon group having 3-24 carbon atoms. These hydrocarbon groups are preferably selected from among straight chain or branched alkyl groups having 3-24 carbon atoms, straight chain or branched alkenyl groups having 3-24 carbon atoms, cycloalkyl groups or straight chain or branched alkyl-cycloalkyl groups having 5-13 carbon atoms, aryl groups or straight chain or branched alkylaryl groups having 6-18 carbon atoms, arylalkyl groups having 7-19 carbon atoms and the like. In addition, the alkyl groups and alkenyl groups may be primary, secondary or tertiary groups.

Preferred examples of the zinc dialkyldithiophosphate include zinc diisopropyldithiophosphate, zinc diisobutyldithiophosphate, zinc di-sec-butyldithiophosphate, zinc di-sec-pentyldithiophosphate, zinc di-n-hexyldithiophosphate, zinc di-sec-hexyldithiophosphate, zinc dioctyldithiophosphate, zinc di-2-ethylhexyldithiophosphate, zinc di-n-decyldithiophosphate, zinc di-n-dodecyldithiophosphate, zinc di-iso-tridecyldithiophosphate, and arbitrary combinations thereof. It is possible to use one of these anti-wear agents in isolation, or a combination of two or more types thereof.

The semi-polar organic boron glycerol ester compound according to the present invention is an ester compound represented by chemical formula 1 below. The content of the semi-polar organic boron glycerol ester compound is preferably from 0.015 to 0.040 mass %, and more preferably from 0.018 to 0.040 mass %, in terms of boron content relative to the overall quantity of the composition. If this content is lower than 0.015 mass %, the required cleaning properties and frictional properties cannot be achieved, and if this content exceeds 0.040 mass %, there are concerns that the semi-polar organic boron glycerol ester compound will not uniformly dissolve in the oil, leading to white turbidness.

(1)

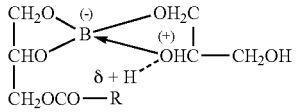

R denotes a straight chain or branched chain alkyl group or straight chain or branched chain alkenyl group having 7-20 carbon atoms In order to increase the effect of the present invention, the semi-polar organic boron glycerol ester compound is preferably glycerol monooleyl glycerol borate represented by chemical formula 2 below, glycerol monopalmityl glycerol borate or glycerol monolinoleate glycerol borate.

(2)

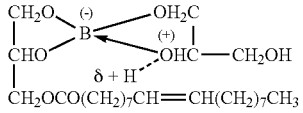

If necessary, the lubricating oil composition according to the present invention can contain viscosity index improving agents, antioxidants, friction modifiers, rust inhibitors, corrosion inhibitors, anti-foaming agents, and the like. In addition, it is possible to use an additive package which is obtained by appropriately mixing and packaging additives such as an ashless dispersing agent, a metal-containing detergent, a zinc dialkyldithiophosphate and an antioxidant as appropriate in advance, and it is possible to use a combination of the additives mentioned above and the package.

Explanations will now be given of the physical properties of the lubricating oil composition for internal combustion engines according to the present invention.

The physical properties of the lubricating oil composition for internal combustion engines according to the present invention are evaluated in terms of the following characteristics.

Frictional properties are evaluated by means of an EHD2 ultra thin film measurement system manufactured by PCS (available in Japan from Shima Trading Co., Ltd.). The coefficient of friction was evaluated using a ¾ inch steel ball and a steel disk having a diameter of 100 mm, at an oil temperature of 120° C., a disk rotational speed of 10 mm/s, a ball/disk slide ratio of 20% and a load of 20N. According to the lubricating oil composition for internal combustion engines according to the present invention, it is possible to achieve excellent frictional properties and a coefficient of friction of less than 0.05.

High temperature cleaning properties are evaluated by carrying out a hot tube test (JPI-5S-55-99). The evaluation was carried out at a test temperature of 290° C. According to the lubricating oil composition for internal combustion engines according to the present invention, it is possible to achieve excellent high temperature cleaning properties and an evaluation score of 7 or higher.

Thermal and oxidation stability was evaluated in terms of changes in kinematic viscosity at 40° C. and increase in acid value (mg KOH/g) after an internal combustion engine lubricating oil oxidation stability test carried out in accordance with JIS K 2514 (ISOT) (165.5° C., 96 hours), and corrosion of metals was evaluated in terms of the concentration of dissolved iron and copper in the oil. In particular, some modern large capacity diesel engines for commercial vehicles use copper alloys in bearings (see Tribology Technology for Friction Reduction, Kikuchi and Ashida, Tribologist, Vol. 57, No. 9 (2012) pages 605-611), and it is desirable for the quantity of copper eluted into an oil to be less than 100 ppm. According to the lubricating oil composition for internal combustion engines according to the present invention, it is possible to reduce deterioration in thermal and oxidation stability if the change in kinematic viscosity at 40° C. is less than ±10% and the increase in total acid value is 1.5 mg KOH/g or less, and it is also desirable for the quantity of copper eluted into an oil to be less than 100 ppm.

The lubricating oil composition for internal combustion engines according to the present invention is a lubricating oil designed to lubricate components of bearings, valve trains, pistons and cylinders in internal combustion engines.

The present invention will now be explained in greater detail through the use of working examples and comparative examples, but is not limited to these examples.

EXAMPLES

The raw materials used in Working Examples 1-7 and Comparative Examples 1-12 are as follows.

Base Oils:

Base oil 1: Base oil belonging to group 3 of the API categories, obtained by Fisher Tropsch synthesis, kinematic viscosity 4.1 $mm^2/s$ (at 100° C.) and 17.9 $mm^2/s$ (at 40° C.), viscosity index 130, sulfur content less than 0.01 mass % (determined in accordance with JIS K 2541-4: radiation excitation method). NOACK evaporation loss (reduced pressure of 20 mm $H_2O$, 1 hour, ASTM D5800) 13.2 mass %, % CA value determined by n-d-M ring analysis 0%, % CN value 7.9%, % CP value 92.1% (ASTM D3238), flash point determined in accordance with JIS K 2265-4 COC 220° C., pour point determined in accordance with JIS K 2269 −37.5° C.

Base oil 2: Base oil belonging to group 3 of the API categories, obtained by Fisher Tropsch synthesis, kinematic viscosity 7.6 $mm^2/s$ (at 100° C.) and 43.7 $mm^2/s$ (at 40° C.), viscosity index 143, sulfur content less than 0.01 mass % (determined in accordance with JIS K 2541-4: radiation excitation method). NOACK evaporation loss (reduced pressure of 20 mm $H_2O$, 1 hour, ASTM D5800) 4.6 mass %, % CA value determined by n-d-M ring analysis 0%, % CN value 12%, % CP value 88% (ASTM D3238), flash point determined in accordance with JIS K 2265-4 COC 248° C., pour point determined in accordance with JIS K 2269 −15° C.

Base oil 3: Base oil belonging to group 1 of the API categories, obtained by solvent dewaxing, kinematic viscosity 4.6 $mm^2/s$ (at 100° C.) and 24.3 $mm^2/s$ (at 40° C.), viscosity index 104, sulfur content 0.5 mass % (determined in accordance with JIS K 2541-4: radiation excitation method). NOACK evaporation loss (reduced pressure of 20 mm $H_2O$, 1 hour, ASTM D5800) 17.9 mass %, % CA value determined by n-d-M ring analysis 2.5%, % CN value 30.5%, % CP value 67% (ASTM D3238), flash point determined in accordance with JIS K 2265-4 COC 216° C., pour point determined in accordance with JIS K 2269 −17.5° C.

Base oil 4: Base oil belonging to group 2 of the API categories, obtained by hydrotreating through catalytic dewaxing and then hydrofinishing, kinematic viscosity 5.4 $mm^2/s$ (at 100° C.) and 30.5 $mm^2/s$ (at 40° C.), viscosity index 110, sulfur content less than 0.01 mass % (determined in accordance with JIS K 2541-4: radiation excitation method). NOACK evaporation loss (reduced pressure of 20 mm $H_2O$, 1 hour, ASTM D5800) 13.8 mass %, % CA value determined by n-d-M ring analysis 0%, % CN value 31.7%, % CP value 68.3% (ASTM D3238), flash point determined in accordance with JIS K 2265-4 COC 228° C., pour point determined in accordance with JIS K 2269 −20° C.

Nitrogen-containing ashless dispersing agent: An alkylsuccinic acid imide having a nitrogen content of 1.2 mass % was used as a nitrogen-containing ashless dispersing agent.

Ashless dispersing agent A: Non-boronated succinic acid imide having a weight average molecular weight of approximately 5000-10,000, manufactured by Infineum. A succinic acid imide having a nitrogen content of 1.2 mass % was used as a nitrogen-containing ashless dispersing agent.

Ashless dispersing agent B: Boronated succinic acid imide having a weight average molecular weight of approximately 3000-6000, manufactured by Infineum. A boronated alkylsuccinic acid imide having a nitrogen content of 1.2 mass % was used as a nitrogen-containing ashless dispersing agent.

Metal-containing Detergent:

The detergent used was an overbased calcium salicylate commonly used in lubricating oils for internal combustion engines, which had a base number of 230 mg KOH/g and a Ca content of 8.0 mass %.

Zinc Dialkyldithiophosphate:

Here, a secondary zinc dialkyldithiophosphate containing alkyl groups having 3 and 6 carbon atoms (anti-wear agent 1) and a primary zinc dialkyldithiophosphate containing alkyl groups having 4 and 5 carbon atoms (anti-wear agent 2) were used as anti-wear agents. Anti-wear agent 1 was Lz-1371 manufactured by Lubrizol Corporation, which is a typical zinc dialkyldithiophosphate having secondary alkyl groups, and having a phosphorus content of 10.0 mass %, a zinc content of 10.7 mass % and a sulfur content of 21.0 mass %, and anti-wear agent 2 was Lz-1395 manufactured by Lubrizol Corporation, which is a typical zinc dialkyldithiophosphate having primary alkyl groups, and having a phosphorus content of 9.6 mass %, a zinc content of 10.5 mass % and a sulfur content of 20.0 mass %.

Semi-polar Organic Boron Glycerol Ester Compound:

Glycerol monooleyl glycerol borate (oily agent 2) was used as the semi-polar organic boron glycerol ester compound. A compound having a boron content of 2.4 mass % was used.

Other Components:

Antioxidants:

Antioxidant 1: Phenol-based antioxidant, 3,5-bis(1,1-dimethyl-ethyl)-4-hydroxyalkyl benzene propanoate (7-9 carbon atoms in side chain).

Antioxidant 2: Amine-based antioxidant, alkylated diphenylamine.

Viscosity Index Improving Agent Solution:

The molecular weight was obtained by using a Shodex GPC-101 high performance liquid chromatography apparatus manufactured by Showa Denko Kabushiki Kaisha, setting a temperature of 40° C., using a differential refractive index (RI) detector as a detector, using THF as a carrier gas at a flow rate of 1.0 ml/min (Ref 0.3 ml/min) and setting the sample injection quantity to be 100 μL, using a combination of {KF-G (Shodex)×1 and KF-805L (Shodex×2)} as a column, using a range that corresponds to peak molecular weights of 2600-690,000, and calculating the average molecular weight (weight average molecular weight, number average molecular weight and Z average molecular weight in terms of polystyrene).

Viscosity index improving agent solution 1: Non-dispersed type styrene-divinylbenzene copolymer, number average molecular weight 430,000, weight average molecular weight 440,000, Z average molecular weight 440,000.

Viscosity index improving agent solution 2: Dispersed type polymethacrylate-based polymer, number average molecular weight 220,000, weight average molecular weight 230,000, Z average molecular weight 240,000.

Anti-foaming Agent:

A 3 mass % solution of DCF obtained by dissolving 3 mass % of a polymethylsiloxane (a silicone oil) having a weight average molecular weight of approximately 30,000 in JIS No. 1 kerosene was used as an anti-foaming agent.

Oily Agents:

Oily agent 1: Glycerol monoisostearate.

Oily agent 2: The semi-polar organic boron glycerol ester compound mentioned above.

Lubricating oil compositions according to Working Examples 1-7 and Comparative Examples 1-12 were obtained by mixing and stirring components according to the formulations shown in Table 1 and Table 2 below.

The lubricating oil compositions prepared using the raw materials and production method mentioned above were evaluated in terms of frictional properties, high temperature cleaning properties, thermal and oxidation stability and corrosion of metals according to the evaluation methods mentioned above, and the results are shown in Tables 1 and 2 below. Moreover, the evaluation methods for frictional properties, high temperature cleaning properties, thermal and oxidation stability and corrosion of metals are as follows:

Coefficient of friction<0.05: ○ (pass)
Coefficient of friction>0.07: x (fail)
High Temperature Cleaning Properties
Evaluation score≥7.0: ○
Evaluation score<1.0: x
Thermal and Oxidation Stability
Increase in acid value (mg KOH/g)≤1.5: ○
Increase in acid value (mg KOH/g)>1.5: x
−10<change in kinematic viscosity at 40° C. (%)<10: ○
Change in kinematic viscosity at 40° C. (%)≤−10 or ≥10: x
Corrosion of Metals
Cu concentration in oil (ppm)<100: ○
Cu concentration in oil (ppm)≥100: x

TABLE 1

| | | Working Example 1 | Working Example 2 | Working Example 3 | Working Example 4 | Working Example 5 | Working Example 6 | Working Example 7 | Comparative Example 1 | Comparative Example 2 | Comparative Example 3 |
|---|---|---|---|---|---|---|---|---|---|---|---|
| Base oil 1 | | 48.62 | 48.42 | 48.82 | 47.92 | | 49.42 | 47.62 | 49.42 | 49.12 | 48.42 |
| Base oil 2 | | 29.20 | 29.20 | 29.20 | 29.20 | | 29.20 | 29.20 | 29.20 | 29.20 | 29.20 |
| Base oil 3 | | | | | | | | | | | |
| Base oil 4 | | | | | | 79.82 | | | | | |
| Ashless dispersing agent A | | 8.00 | 8.00 | 8.00 | 8.00 | 8.00 | 8.00 | 8.00 | 8.00 | 8.00 | 8.00 |
| Metal-based detergent | | 2.70 | 2.70 | 2.70 | 2.70 | 2.70 | 2.70 | 2.70 | 2.70 | 2.70 | 2.70 |
| Anti-wear agent 1 | | 0.80 | 0.80 | 0.80 | 0.80 | 0.80 | 0.80 | 0.80 | 0.80 | 0.80 | 0.80 |
| Anti-wear agent 2 | | 0.40 | 0.40 | | 0.40 | 0.40 | 0.40 | 0.40 | 0.40 | 0.40 | 0.40 |
| Antioxidant 1 | | 1.20 | 1.20 | 1.20 | 1.20 | 1.20 | 1.20 | 1.20 | 1.20 | 1.20 | 1.20 |
| Antioxidant 2 | | 1.05 | 1.05 | 1.05 | 1.05 | 1.05 | 1.05 | 1.05 | 1.05 | 1.05 | 1.05 |
| Viscosity index improving agent 1 | | 7.20 | 7.20 | 7.20 | 7.20 | 5.20 | 4.20 | 7.20 | 7.20 | 7.20 | 7.20 |
| Viscosity index improving agent 2 | | | | | | | 1.90 | | | | |
| 3 mass % solution of DCF | | 0.03 | 0.03 | 0.03 | 0.03 | 0.03 | 0.03 | 0.03 | 0.03 | 0.03 | 0.03 |
| Oily agent 1 | | | | | | | | 1.00 | | 0.30 | 1.00 |
| Oily agent 2 | | 0.80 | 1.00 | 1.00 | 1.50 | 0.80 | 0.80 | 0.80 | | | |
| Ashless dispersing agent B | | | | | | | | | | | |
| | | 100.00 | 100.00 | 100.00 | 100.00 | 100.00 | 100.00 | 100.00 | 100.00 | 100.00 | 100.00 |
| Frictional properties | | ○ | ○ | ○ | ○ | ○ | ○ | ○ | x | x | ○ |
| High temperature cleaning properties | | ○ | ○ | ○ | ○ | ○ | ○ | ○ | ○ | x | x |
| Thermal and oxidation stability | | ○ | ○ | ○ | ○ | ○ | ○ | ○ | ○ | ○ | ○ |
| Corrosion | | ○ | ○ | ○ | ○ | ○ | ○ | ○ | ○ | ○ | ○ |
| Kinematic viscosity at 40° C. | $mm^2/s$ | 61.1 | 61.3 | 61.0 | 61.3 | 71.2 | 58.0 | 61.1 | 61.2 | 61.3 | 60.4 |
| Kinematic viscosity at 100° C. | $mm^2/s$ | 10.58 | 10.62 | 10.54 | 10.59 | 10.60 | 10.58 | 10.53 | 10.63 | 10.65 | 10.48 |
| Viscosity index | | 164 | 164 | 164 | 164 | 136 | 175 | 163 | 166 | 165 | 164 |
| Acid value | mg KOH/g | 2.21 | 2.13 | 2.1 | 2.17 | 2.28 | 2.42 | 2.19 | 1.95 | 1.96 | 2.2 |
| Base number (HCl) | mg KOH/g | 6.83 | 6.78 | 6.92 | 6.56 | 7.01 | 7.01 | 6.8 | 6.95 | 6.86 | 6.49 |

TABLE 1-continued

| | | Working Example 1 | Working Example 2 | Working Example 3 | Working Example 4 | Working Example 5 | Working Example 6 | Working Example 7 | Comparative Example 1 | Comparative Example 2 | Comparative Example 3 |
|---|---|---|---|---|---|---|---|---|---|---|---|
| B concentration | mass % | 0.018 | 0.024 | 0.024 | 0.036 | 0.018 | 0.018 | 0.018 | <0.001 | <0.001 | <0.001 |
| Ca concentration | mass % | 0.22 | 0.22 | 0.22 | 0.22 | 0.22 | 0.22 | 0.22 | 0.22 | 0.22 | 0.22 |
| P concentration | mass % | 0.116 | 0.116 | 0.079 | 0.116 | 0.116 | 0.116 | 0.116 | 0.116 | 0.116 | 0.116 |
| Zn concentration | mass % | 0.127 | 0.127 | 0.087 | 0.127 | 0.127 | 0.127 | 0.127 | 0.127 | 0.127 | 0.127 |
| N concentration | mass % | 0.14 | 0.14 | 0.14 | 0.14 | 0.14 | 0.14 | 0.14 | 0.14 | 0.14 | 0.14 |
| Hot Tube 290° C. | Merit point | 8.0 | 8.0 | 8.0 | 8.0 | 8.0 | 8.0 | 8.0 | 8.0 | 0.5 | 0.5 |
| EHD machine coefficient of friction | | <0.05 | <0.05 | <0.05 | <0.05 | <0.05 | <0.05 | <0.05 | >0.07 | >0.07 | <0.05 |
| Change in kinematic viscosity at 40° C. | % | −1.60 | −1.75 | −1.08 | −1.47 | −0.39 | −2.43 | −2.44 | −5.21 | −5.20 | −4.59 |
| Increase in acid value | mg KOH/g | 0.16 | 0.40 | 0.35 | 0.32 | 0.38 | 0.19 | 0.50 | 1.22 | 1.03 | 0.36 |
| Eluted Cu concentration | ppm | 93 | 87 | 92 | 90 | 90 | 90 | 70 | 96 | 85 | 90 |

TABLE 2

| | | Comparative Example 4 | Comparative Example 5 | Comparative Example 6 | Comparative Example 7 | Comparative Example 8 | Comparative Example 9 | Comparative Example 10 | Comparative Example 11 | Comparative Example 12 |
|---|---|---|---|---|---|---|---|---|---|---|
| Base oil 1 | | 49.12 | 48.92 | 47.42 | 48.42 | 47.42 | 47.42 | 46.42 | | 50.52 |
| Base oil 2 | | 29.20 | 29.20 | 29.20 | 29.20 | 29.20 | 29.20 | 29.20 | | 29.20 |
| Base oil 3 | | | | | | | | | 77.82 | |
| Base oil 4 | | | | | | | | | | |
| Ashless dispersing agent A | | 8.00 | 8.00 | 8.00 | 8.00 | 8.00 | 8.00 | 8.00 | 8.00 | 8.00 |
| Metal-based detergent | | 2.70 | 2.70 | 2.70 | 2.70 | 2.70 | 2.70 | 2.70 | 2.70 | 2.70 |
| Anti-wear agent 1 | | 0.80 | 0.80 | 0.80 | 0.80 | 0.80 | 0.80 | 0.80 | 0.80 | 0.80 |
| Anti-wear agent 2 | | 0.40 | 0.40 | 0.40 | 0.40 | 0.40 | 0.40 | 0.40 | 0.40 | 0.40 |
| Antioxidant 1 | | 1.20 | 1.20 | 1.20 | 1.20 | 1.20 | 1.20 | 1.20 | 1.20 | 1.20 |
| Antioxidant 2 | | 1.05 | 1.05 | 1.05 | 1.05 | 1.05 | 1.05 | 1.05 | 1.05 | 1.05 |
| Viscosity index improving agent 1 | | 7.20 | 7.20 | 7.20 | 7.20 | 7.20 | 7.20 | 7.20 | 7.20 | 4.20 |
| Viscosity index improving agent 2 | | | | | | | | | | 1.90 |
| 3 mass % solution of DCF | | 0.03 | 0.03 | 0.03 | 0.03 | 0.03 | 0.03 | 0.03 | 0.03 | 0.03 |
| Oily agent 1 | | | | | | | 1.00 | 1.00 | | |
| Oily agent 2 | | 0.30 | 0.50 | 2.00 | | | | | 0.80 | |
| Ashless dispersing agent B | | | | | 1.00 | 2.00 | 1.00 | 2.00 | | |
| Notes | | | | Insoluble | | | | | | |
| | | 100.00 | 100.00 | 100.00 | 100.00 | 100.00 | 100.00 | 100.00 | 100.00 | 100.00 |
| Frictional properties | | x | x | | x | x | ○ | x | ○ | x |
| High temperature cleaning properties | | x | x | | ○ | ○ | ○ | ○ | ○ | x |
| Thermal and oxidation stability | | ○ | ○ | | ○ | ○ | ○ | ○ | ○ | ○ |
| Corrosion | | ○ | ○ | | x | x | x | x | x | ○ |
| Kinematic viscosity at 40° C. | $mm^2/s$ | 60.9 | 61.0 | | 63.0 | 64.1 | 61.7 | 63.8 | 67.2 | 57.9 |
| Kinematic viscosity at 100° C. | $mm^2/s$ | 10.55 | 10.58 | | 10.69 | 10.99 | 10.64 | 10.88 | 10.68 | 10.53 |
| Viscosity index | | 164 | 164 | | 161 | 164 | 164 | 163 | 148 | 174 |
| Acid value | mg KOH/g | 2.01 | 2.11 | | 2.21 | 2.24 | 2.24 | 2.31 | 2.43 | 2.38 |
| Base number (HCl) | mg KOH/g | 6.96 | 6.88 | | 6.93 | 7.14 | 6.94 | 6.98 | 7.03 | 7.1 |
| B concentration | mass % | 0.007 | 0.012 | | 0.013 | 0.026 | 0.013 | 0.027 | 0.018 | <0.001 |
| Ca concentration | mass % | 0.22 | 0.22 | | 0.22 | 0.22 | 0.22 | 0.22 | 0.22 | 0.22 |
| P concentration | mass % | 0.116 | 0.116 | | 0.116 | 0.116 | 0.116 | 0.116 | 0.116 | 0.116 |
| Zn concentration | mass % | 0.127 | 0.127 | | 0.127 | 0.127 | 0.127 | 0.127 | 0.127 | 0.127 |
| N concentration | mass % | 0.14 | 0.14 | | 0.14 | 0.15 | 0.15 | 0.15 | 0.14 | 0.14 |
| Hot Tube 290° C. | Merit point | 0.5 | 0.5 | | 8.0 | 8.0 | 8.0 | 8.0 | 8.0 | 0.5 |
| EHD machine coefficient of friction | | >0.07 | >0.07 | | >0.07 | >0.07 | <0.05 | >0.07 | <0.05 | >0.07 |

TABLE 2-continued

| | | Comparative Example 4 | Comparative Example 5 | Comparative Example 6 | Comparative Example 7 | Comparative Example 8 | Comparative Example 9 | Comparative Example 10 | Comparative Example 11 | Comparative Example 12 |
|---|---|---|---|---|---|---|---|---|---|---|
| Change in kinematic viscosity at 40° C. | % | −1.94 | −1.80 | | −4.94 | −6.59 | −4.68 | −5.94 | −1.56 | −2.30 |
| Increase in acid value | mg KOH/g | 0.60 | 0.46 | | 0.66 | 0.83 | 0.37 | 0.81 | 0.94 | 0.16 |
| Eluted Cu concentration | ppm | 80 | 91 | | 130 | 150 | 180 | 160 | 120 | 85 |

As shown in Tables 1 and 2, Working Examples 1-7 were all evaluated as ○ (pass) for frictional properties, high temperature cleaning properties, thermal and oxidation stability and corrosion of metals, and it was understood that the lubricating oil composition for internal combustion engines according to the present invention is excellent in terms of frictional properties, high temperature cleaning properties, thermal and oxidation stability and corrosion of metals.

That which is claimed is:

1. A lubricating oil composition for internal combustion engines, which comprises the following components:

(a) a lubricant base oil having a kinematic viscosity at 100° C. of from 2 to 12mm$^2$/s, which is a single API group 2 or group 3 base oil having a viscosity index of 95 or higher, a sulfur content of 0.03 mass % or lower and % CA value of 1 or lower, (b) a nitrogen-containing ashless dispersing agent at a quantity of 0.01-0.3 mass % in terms of nitrogen content relative to the overall composition, wherein a weight average molecular weight of the nitrogen-containing ashless dispersing agent ranges between 1,000 to 20,000, (c) a metal-containing detergent, which contains calcium as an alkaline earth metal, at a quantity of 0.05-0.3 mass % in terms of alkaline earth metal content relative to the overall composition, (d) a zinc dialkyldithiophosphate at a quantity of 0.05-0.13 mass % in terms of phosphorus content relative to the overall composition, and (e) an oil-soluble semi-polar organic boron glycerol ester compound represented by chemical formula 1, (1)

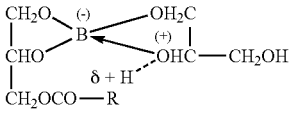

at a quantity of 0.015-0.040 mass % in terms of boron content relative to the overall composition, wherein R denotes a straight chain or branched chain alkyl group or straight chain or branched chain alkenyl group having 7-20 carbon atoms; and wherein the lubricating oil composition comprises less than a ±10% change in kinematic viscosity at 40° C., a 1.5 mg KOH/g or less increase in total acid value, and a less than 100 ppm in an eluted copper (Cu) concentration.

2. A lubricating oil composition for internal combustion engines according to claim 1, wherein the nitrogen-containing ashless dispersing agent contains an additive selected from among the group consisting of a boronated or non-boronated alkylsuccinimide or alkenylsuccinimide, a boronated or non-boronated alkylsuccinic acid ester or alkenylsuccinic acid ester, a boronated or non-boronated alkylsuccinic acid imide or alkenylsuccinic acid imide, a boronated or non-boronated alkylsuccinic acid amide or alkenylsuccinic acid amide, or an arbitrary combination thereof.

3. A lubricating oil composition for internal combustion engines according to claim 1, wherein the metal-containing detergent contains a salicylate, a carboxylate or a sulfonate as a primary component.

4. A lubricating oil composition for internal combustion engines according to claim 1, wherein the zinc dialkyldithiophosphate comprises a primary or secondary alkyl group having 3-8 carbon atoms.

5. A lubricating oil composition for internal combustion engines according to claim 1, wherein the semi-polar organic boron glycerol ester compound is glycerol monooleyl glycerol borate, as represented by chemical formula 2

(2)

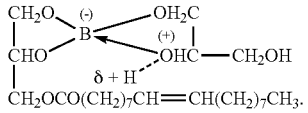

* * * * *